US009731859B1

(12) United States Patent
Volkmann

(10) Patent No.: US 9,731,859 B1
(45) Date of Patent: Aug. 15, 2017

(54) CONTAINER WITH OVERLAPPING FLAP SYSTEM AND CONTAINER BLANK FOR MAKING THE SAME

(71) Applicant: Wolfgang Volkmann, Edmonton (CA)

(72) Inventor: Wolfgang Volkmann, Edmonton (CA)

( * ) Notice: Subject to any disclaimer, the term of this patent is extended or adjusted under 35 U.S.C. 154(b) by 0 days.

(21) Appl. No.: 15/212,188

(22) Filed: Jul. 15, 2016

(51) Int. Cl.

| | |
|---|---|
| ***B65D 5/46*** | (2006.01) |
| ***B65D 5/44*** | (2006.01) |
| ***B65D 5/02*** | (2006.01) |
| ***B65D 5/468*** | (2006.01) |

(52) U.S. Cl.
CPC ..... *B65D 5/443* (2013.01); *B65D 5/0227* (2013.01); *B65D 5/4608* (2013.01)

(58) Field of Classification Search
CPC ..... B65D 5/443; B65D 5/4608; B65D 5/10; B65D 5/0254
USPC ..... 229/155, 156, 157, 185, 117.16
See application file for complete search history.

(56) References Cited

U.S. PATENT DOCUMENTS

| | | | | |
|---|---|---|---|---|
| 2,502,384 | A * | 3/1950 | Loth | B65D 5/48016 229/120.17 |
| 2,540,712 | A * | 2/1951 | Cassidy | B65D 5/48016 229/127 |
| 2,703,197 | A * | 3/1955 | Brasch | B65D 5/4608 229/117.17 |
| 2,743,863 | A * | 5/1956 | Glaser | B65D 5/48008 229/120.17 |
| 3,062,426 | A * | 11/1962 | Mason | B65D 5/0281 229/117.16 |
| 3,989,181 | A * | 11/1976 | Wilcox | B65D 5/06 229/117.17 |
| 7,789,292 | B2 | 9/2010 | West | |
| 2006/0163333 | A1 | 7/2006 | Kornacki | |

* cited by examiner

*Primary Examiner* — Christopher Demeree
(74) *Attorney, Agent, or Firm* — Richard D. Okimaw

(57) ABSTRACT

A container blank for forming container comprising: a) a first end wall panel having a top, a bottom, a left side and a right side; b) a first side wall panel having a top, a bottom, a left side and a right side; c) a second side wall panel having a top, a bottom, a left side and a right side; d) a second end wall panel having a top, a bottom, a left side and a right side; e) a first top flap; f) a second top flap; g) a third top flap; h) a fourth top flap; i) a first bottom flap having a middle fold line; j) a first pair of minor bottom flaps; k) a second bottom flap having a middle fold line; and l) a second pair of minor bottom flaps and a container derived from the container blank disclosed herein.

10 Claims, 7 Drawing Sheets

CONTAINER WITH OVERLAPPING FLAP SYSTEM AND CONTAINER BLANK FOR MAKING THE SAME

FIELD OF THE INVENTION

The present disclosure is in the field of blank sheets of material for forming a container and containers formed from the same blank sheets of material.

BACKGROUND OF THE DISCLOSURE

In the shipping and packaging industry a variety of containers are constructed from corrugated paperboard having adhesively bonded layers. These corrugated fiberboard containers are typically derived from a paperboard blank. With these of containers, the container may have a handle that causes the paper material of the container to tear at the access hole provided by the handle. Moreover, other problems common to corrugated fiberboard containers are that are particularly challenging are with a bottom side of the box where weight and stress are the highest. In some instances, tape, lock tabs or another means are required to secure the bottom flaps together.

There is a need for a foldable box corrugated paperboard design that includes a bottom flap system and handle access with a greater resistance to failure.

SUMMARY OF THE INVENTION

A container blank for forming container, comprising: a) a first end wall panel having a top, a bottom, a left side and a right side, wherein the first end wall panel has a top fold line, a right side fold line and a bottom side fold line; b) a first side wall panel having a top, a bottom, a left side and a right side, wherein the first side wall panel has a top fold line, a right side fold line and is connected along its left side to the right side of the first end wall panel; c) a second side wall panel having a top, a bottom, a left side and a right side, wherein the second side wall panel has a top fold line, a right side fold line and a bottom side fold line and is connected along its left side to the right side of the first side wall panel; d) a second end wall panel having a top, a bottom, a left side and a right side, wherein the second end wall panel has a top fold line, a right side fold line and a bottom side fold line and is connected along its left side to the right side of the second side wall panel; e) a first top flap, wherein the first top flap is connected along the top side of the first end wall panel; f) a second top flap, wherein the second top flap is connected along the top side of the first side wall panel, and wherein the second top flap has a first handle support; g) a third top flap, wherein the third top flap is connected along the top side of the second side wall panel; h) a fourth top flap, wherein the fourth top flap is connected along the top side of the second end wall panel, and wherein the fourth top flap has a second handle support; i) a first bottom flap having a middle fold line, wherein the first bottom flap is connected along the bottom side of the first end wall panel; j) a first pair of minor bottom flaps are connected to the bottom side of the first side wall panel, wherein each first minor bottom flap is separated by a first minor bottom flap vertical slot, and wherein each minor bottom flap has a minor bottom flap fold line; k) a second bottom flap having a middle fold line, wherein the second bottom flap is connected along the bottom side of the second side wall panel; and l) a second pair of minor bottom flaps are connected to the bottom side of the second end wall panel, wherein each second minor bottom flap is separated by a second minor bottom flap vertical slot, and wherein each second minor bottom flap has a minor bottom flap fold line.

In another aspect, disclosed herein is a container derived from the container blank disclosed herein, comprising: a) a first end wall panel and a second end panel are adjoined via a glue tab thereby defining an inner container portion and an outer container portion; b) a first pair of minor bottom flaps and a second pair of minor bottom flaps, wherein the first pair of minor bottom flaps and the second pair of minor bottom flaps are folded towards the inner container portion along each minor bottom flap fold line, wherein a first left minor bottom flap overlaps with a second right minor bottom flap, wherein a first right minor bottom flap overlaps with a second left minor bottom flap, wherein each first minor bottom flap is separated by a first minor bottom flap vertical slot, and wherein each second minor bottom flap is separated by a second minor bottom flap vertical slot; c) a first bottom flap and a second bottom flap, wherein the first bottom flap and the second bottom flap each comprise a top half and a bottom half separated by a middle fold line horizontally positioned at about the center of the first bottom flap and the second bottom flap, wherein the first minor bottom flap vertical slot and the second minor bottom flap vertical slot are capable of receiving each bottom half of the first bottom flap and the second bottom flap, wherein the first bottom flap and the second bottom flap are folded toward the inner container portion along each bottom fold line and along each middle fold line, and wherein the first minor bottom flap vertical slot and the second minor bottom flap are folded along each middle fold line in opposite directions thereby forming a flat inner bottom surface of the container; d) a first top flap, wherein the first top flap is connected along the top side of the first end wall panel; e) a second top flap, wherein the second top flap is connected along the top side of the first side wall panel, and wherein the second top flap has a first handle support; f) a third top flap, wherein the third top flap is connected along the top side of the second side wall panel; and g) a fourth top flap, wherein the fourth top flap is connected along the top side of the second end wall panel, and wherein the fourth top flap has a second handle support.

DETAILED DESCRIPTION OF THE EMBODIMENTS

The following is a detailed description of certain specific embodiments of the container blank and container as disclosed herein.

In one aspect, disclosed herein is a container blank for forming container, comprising: a) a first end wall panel having a top, a bottom, a left side and a right side, wherein the first end wall panel has a top fold line, a right side fold line and a bottom side fold line; b) a first side wall panel having a top, a bottom, a left side and a right side, wherein the first side wall panel has a top fold line, a right side fold line and is connected along its left side to the right side of the first end wall panel; c) a second side wall panel having a top, a bottom, a left side and a right side, wherein the second side wall panel has a top fold line, a right side fold line and a bottom side fold line and is connected along its left side to the right side of the first side wall panel; d) a second end wall panel having a top, a bottom, a left side and a right side, wherein the second end wall panel has a top fold line, a right side fold line and a bottom side fold line and is connected along its left side to the right side of the second side wall panel; e) a first top flap, wherein the first top flap is connected along the top side of the first end wall panel; f) a second top flap, wherein the second top flap is connected along the top side of the first side wall panel, and wherein the second top flap has a first handle support; g) a third top flap, wherein the third top flap is connected along the top side of the second side wall panel; h) a fourth top flap, wherein the fourth top flap is connected along the top side of the second end wall panel, and wherein the fourth top flap has a second handle support; i) a first bottom flap having a middle fold line, wherein the first bottom flap is connected along the bottom side of the first end wall panel; j) a first pair of minor bottom flaps are connected to the bottom side of the first side wall panel, wherein each first minor bottom flap is separated by a first minor bottom flap vertical slot, and wherein each minor bottom flap has a minor bottom flap fold line; k) a second bottom flap having a middle fold line, wherein the second bottom flap is connected along the bottom side of the second side wall panel; and l) a second pair of minor bottom flaps are connected to the bottom side of the second end wall panel, wherein each second minor bottom flap is separated by a second minor bottom flap vertical slot, and wherein each second minor bottom flap has a minor bottom flap fold line, and wherein the first side wall panel has a first handle portion and the second side wall panel has a second handle portion.

Figure 1:
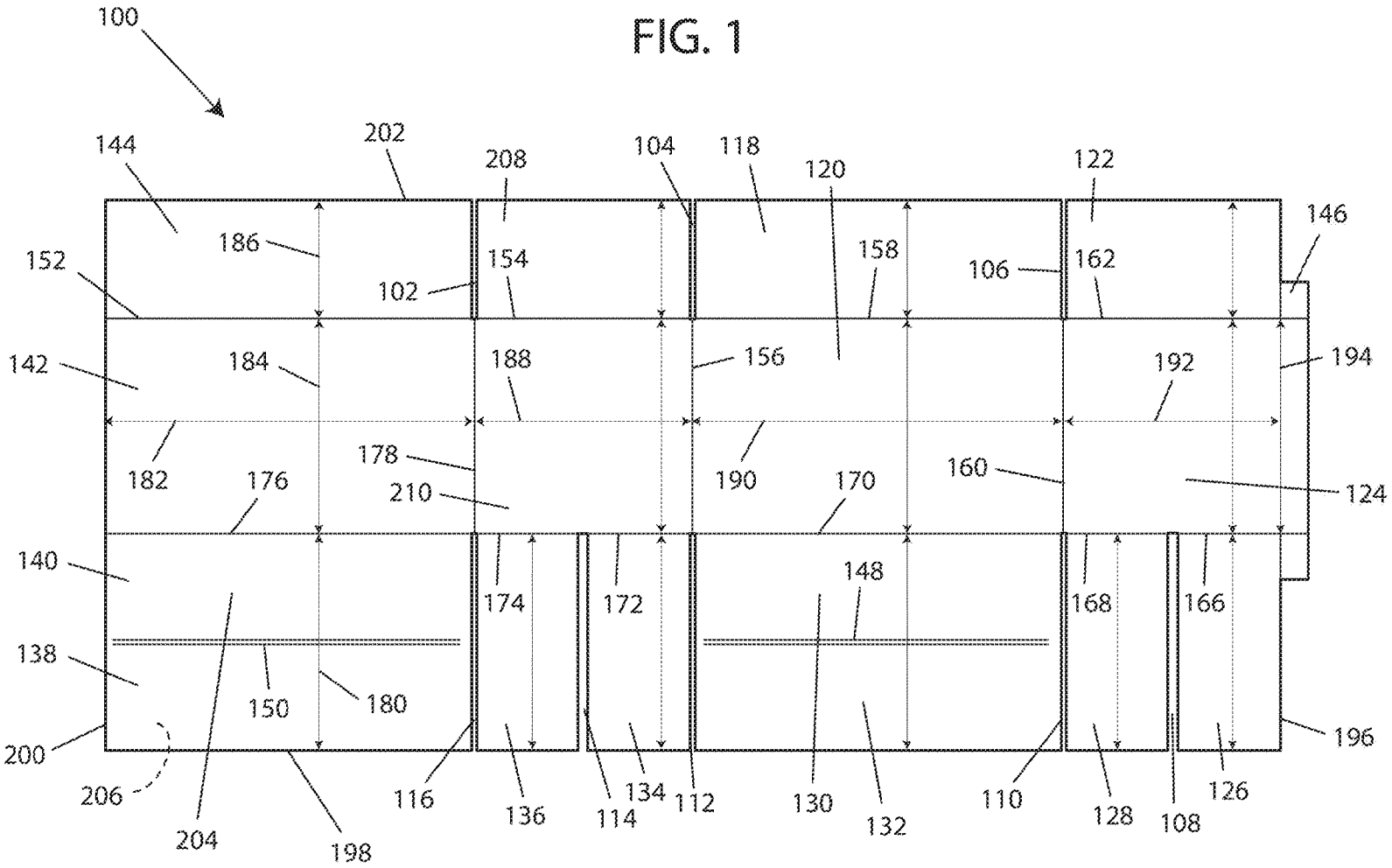
FIG. 1 is an illustration of a container blank 100 as disclosed herein comprising an inner container portion 204.

Turning to the drawings, FIG. 1 illustrates a container blank 100. The blank 100 is used to construct a rectangular or cube shape shaped container. As an example the container blank 100 includes two side wall panels 210 and 120 and two end wall panels 142 and 124 connected to four top flaps 144, 208, 118 and 122 and six bottom flaps 140, 136, 134, 132, 128 and 126. For reference, the container blank 100 has a inner container portion 204, an outer container portion 206, and a left edge 200, right edge 196, top edge 202 and a bottom edge 198. Fold lines are depicted as broken lines in FIG. 1. As used herein, a fold line may be a thin band of a weakened region of material. The thin band of the fold line may be a specific area on a blank formed by conventional manufacturing methods in the paperboard container blank industry. Moreover, the fold line may also be a predetermined area for folding along a part of the blank without a weaken area. The container may be constructed by securing together the edges of a blank including the aforementioned panels.

Furthermore, the top flaps and bottom flaps are provided to form major flaps and minor flaps generally for a rectangular shaped container. Specifically, the major flaps extend from the end wall panels 142 and 124 and the minor flaps extend from the side wall panels 210 and 120 of the blank 100. Moreover, minor flaps 136, 134, 128 and 126 referred to as minor bottom flaps due to their narrow width and the first minor bottom flap vertical slot 114 and the second minor bottom flap vertical slot 108 The major flaps and the minor flaps may be used in shaping either the container top or bottom portions of a fully constructed container. For ease of explanation, the terms "major" and "minor" are used herein for designating a relative width dimension. In general, a major flap has a longer width than a minor flap. The major flaps and the minor flaps may contain features to facilitate production of the container and to provide strength, support and rigidity to the assembled container.

The side wall panel 210 includes a perimeter of top fold line 154, minor bottom flap fold lines 174 and 172, and fold line 178. In some embodiments, the side wall panel 210 has a width 188 of between about 152 mm (6 inches) and 1,524 mm (60 inches). In some embodiments, the side wall panel 210 has a width 188 of about 403.225 mm (15.875 inches). The side wall panel 120 includes a perimeter of top fold line 158, right side fold line 160, fold line 156, bottom fold line 170, and fold line 178. In some embodiments, the side wall panel 120 has a width 190 of between about 152 mm (6 inches) and 1,524 mm (60 inches). In some embodiments, the side wall panel 120 has a width 190 of about 603.25 mm (23.75 inches). The end wall panel 142 includes a perimeter of top fold line 152, right fold line 178, bottom fold line 176. In some embodiments, the end wall panel 142 has a width 182 of between about 152 mm (6 inches) and 1,524 mm (60 inches). In some embodiments, the end wall panel 142 has a width 182 of about 603.25 mm (23.75 inches). The end wall panel 124 includes a perimeter of top fold line 162, fold line 160, minor bottom flap fold lines 166 and 168 and glue strip fold line 194. In some embodiments, the side wall panel 124 has a width 192 of between about 152 mm (6 inches) and 1,524 mm (60 inches). In some embodiments, the side wall panel 124 has a width 192 of about 403.225 mm (15.875 inches). In some embodiments, side wall panel 210, side wall panel 120, end wall panel 142 and end wall panel 124 each have a height 184 of between about 152 mm (6 inches) and 1,524 mm (60 inches). In some embodiments, side wall panel 210, side wall panel 120, end wall panel 142 and end wall panel 124 each have a height 184 of about 403.225 mm (15.875 inches). In some embodiments, the first top flap, second top flap, third top flap and fourth top flap comprise a horizontal fold line. In some embodiments, the first bottom flap, first pair of minor bottom flaps, second bottom flap and second pair of minor bottom flaps each comprise a horizontal fold line.

The first top flap 144 has a perimeter that includes top fold line 152, slot 102, top edge 202 and left edge 200. In some embodiments, the first top flap 144 has a width 182 of between 152 mm (6 inches) and 1,524 mm (60 inches). In some embodiments, the first top flap 144 has a width 182 of about 603.25 mm (23.75 inches). The second top flap 208 has a perimeter that includes slot 102, fold line 154, slot 104 and top edge 202. In some embodiments, the second top flap 208 has a width 188 of between 152 mm (6 inches) and 1,524 mm (60 inches). In some embodiments, the second top flap 208 has a width 188 of about 403.225 mm (15.875 inches). The third top flap 118 has a perimeter that includes slot 104, fold line 158, slot 106 and top edge 202. In some embodiments, the third top flap 118 has a width 190 of between 152 mm (6 inches) and 1,524 mm (60 inches). In some embodiments, the third top flap 118 has a width 190 of about 603.25 mm (23.75 inches). The fourth top flap 122 has a perimeter that includes slot 106, fold line 162, top edge 202 and glue strip fold line 194. In some embodiments, the fourth top flap 122 has a width 192 of between 152 mm (6 inches) and 1,524 mm (60 inches). In some embodiments, the fourth top flap 122 has a width 192 of about 403.225 mm (15.875 inches). In some embodiments, the height of the first top flap 144, second top flap 208, third top flap 118 and the fourth top flap 122 each have a height 186 of between about 152 mm (6 inches) and 1,524 mm (60 inches). In some embodiments, the height of the first top flap 144, second top flap 208, third top flap 118 and the fourth top flap 122 each have a height 186 of about 241.3 mm (9.5 inches). In some embodiments, the width of slots 102, 104, 106, 110 and 112 are each independently 7.9375 mm (0.3125 inches). As such, the widths of the top flaps and bottom flaps may be reduced by the width of slots 102, 104, 106, 110 and 112, respectively.

The first bottom flap 138/140 has a perimeter that includes bottom fold line 176, slot 116, left edge 200 and bottom edge 198. The second bottom flap 130/132 has a perimeter that includes bottom fold line 170, slot 112, slot 110 and bottom edge 198. In some embodiments, the middle fold line 150 of the first bottom flap comprises two adjacent fold lines and the middle fold line 148 of the second bottom flap comprises two adjacent fold lines, wherein each middle fold line is horizontally positioned at about the center of the first bottom flap and the second bottom flap. In some embodiments, the first bottom flap and the second bottom flap each comprise a top half and a bottom half separated by a middle fold line horizontally positioned at about the center of the first bottom flap and the second bottom flap, and wherein the first minor bottom flap vertical slot and the second minor bottom flap vertical slot are capable of receiving each bottom half of the first bottom flap and the second bottom flap. The first pair of minor bottom flaps 136 and 134 have a perimeter that includes minor bottom flap fold lines 174 and 172, bottom edge 198, first minor bottom flap vertical slot 114 and slots 116 and 112, respectively. The second pair of minor bottom flaps 128 and 126 have a perimeter that includes minor bottom flap fold lines 168 and 166, bottom edge 198, second minor bottom flap vertical slot 108 and slot 110 and glue strip fold line 194, respectively. In some embodiments, the first pair of minor bottom flaps comprise a first left minor bottom flap and a first right minor bottom flap, wherein the first left minor bottom flap is separated from the first bottom flap by a first bottom flap slot, and wherein the first right minor bottom flap is separated from the second bottom flap by a second bottom flap slot. In some embodiments, the second pair of minor bottom flaps comprise a second left minor bottom flap and a second right minor bottom flap, wherein the second left minor bottom flap is separated from the second bottom flap by a third bottom flap slot, and wherein the second right minor bottom flap is separated from the second bottom flap by a fourth bottom flap slot. In some embodiments, the height of the first bottom flap 138/140, first pair of minor bottom flaps 136 and 134, second bottom flap 130/132 and the second pair of minor bottom flaps 128 and 126 each have a height 180 of between about 152 mm (6 inches) and 1,524 mm (60 inches). In some embodiments, the height of the first bottom flap 138/140, first pair of minor bottom flaps 136 and 134, second bottom flap 130/132 and the second pair of minor bottom flaps 128 and 126 each have a height 180 of about 396.875 mm (15.625 inches).

Figure 2:
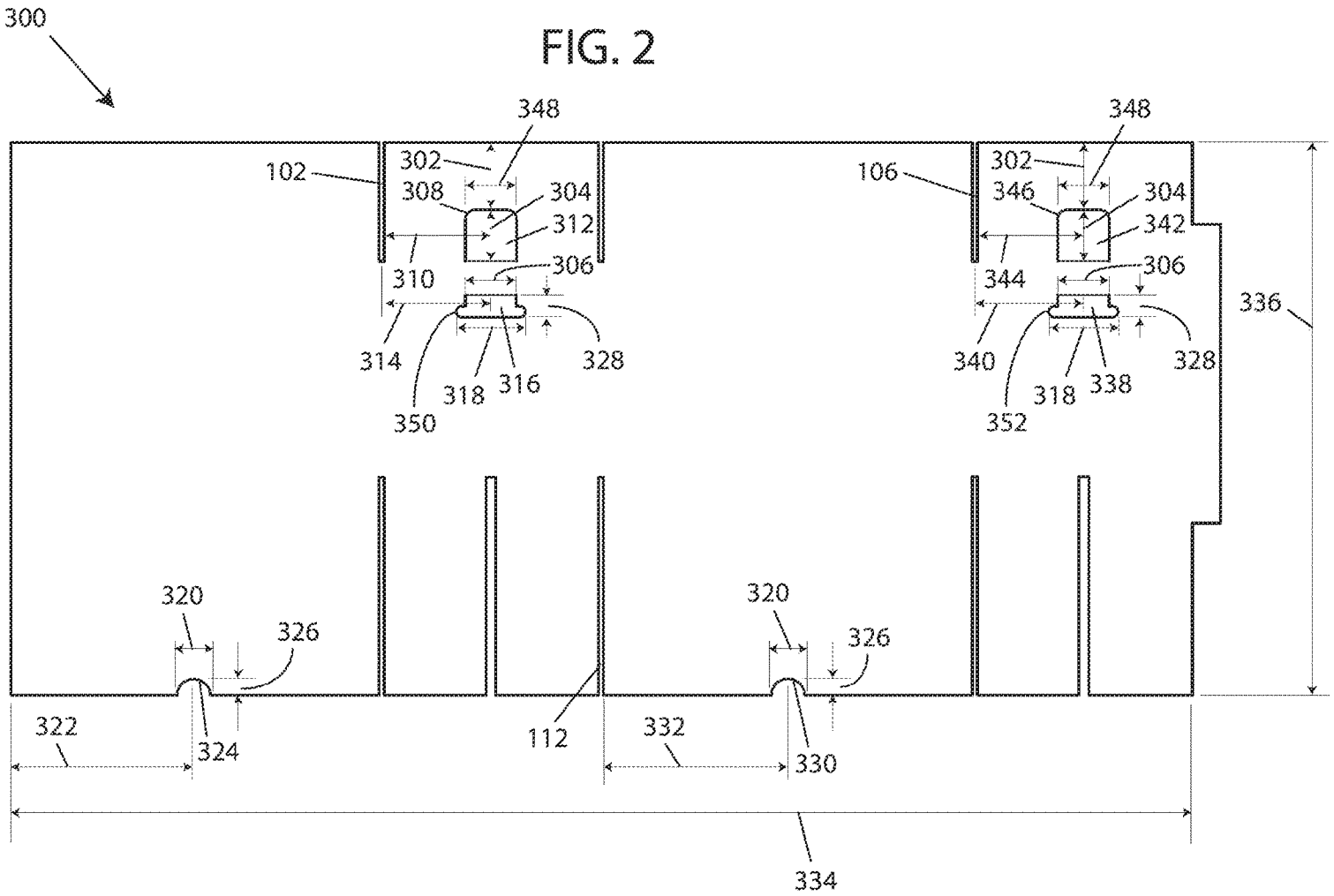
FIG. 2 is an illustration of a container blank 300 as disclosed herein and comprising a first handle portion 316, a second handle portion 338, a first handle support 312 and a second handle support 342.

Turning to the drawings, FIG. 2 is an illustration of a container blank 300 as disclosed herein and comprising a first handle portion 316, a second handle portion 338, a first handle support 312, a second handle support 342, and handle cutouts 350 and 352. As depicted, the second top flap 208 and the fourth top flap 122 comprise a handle support cutouts 308 and 346, first handle support 312 and second handle support 342, first handle portion 316 and second handle portion 338, respectively. In some embodiments, the handle support cutouts 308 and 346 each have a width 348 of between about 63.5 mm (2.5 inches) and 101.6 mm (4 inches). In some embodiments, the handle support cutout 308 and 346 each have a width 348 of about 85.725 mm (3.375 inches). In some embodiments, the handle support cutout 308 and 346 each have a height 304 of between about 63.5 mm (2.5 inches) and 254 mm (10 inches). In some embodiments, the handle support cutouts 308 and 346 each have a height 304 of about 88.9 mm (3.5 inches). In some embodiments, the handle support cutouts 308 and 346 are at a distance 302 between about 76.2 mm (3 inches) and 1,219.2 mm (48 inches) from the top edge 202. In some embodiments, the handle support cutouts 308 and 346 are at a distance 302 of about 152 mm (6 inches) from the top edge 202. In some embodiments, the handle support cutouts 308 and 346 at a distance 310 and 344 of between about 76.2 mm (3 inches) and 1,219.2 mm (48 inches) from the slot 102. In some embodiments, the handle support cutouts 308 and 346 are at a distance 310 and 344 of about 196.85 mm (7.75 inches) from the slot 102. In some embodiments, the first handle portion 316 and second handle portion 338 have a top width 306 of between about 63.5 mm (2.5 inches) and 101.6 mm (4 inches). In some embodiments, the first handle portion 316 and second handle portion 338 have a top width 306 of about 88.9 mm (3.5 inches). In some embodiments, the first handle portion 316 and second handle portion 338 have a bottom width 318 of between about 63.5 mm (2.5 inches) and 152 mm (6 inches). In some embodiments, the first handle portion 316 and second handle portion 338 have a bottom width 318 of about 107.95 mm (4.25 inches). In some embodiments, the first handle portion 316 and second handle portion 338 have a height 328 of between about 12.7 mm (0.5 inches) and 101.6 mm (4 inches). In some embodiments, the first handle portion 316 and second handle portion 338 have a height 328 of about 38.1 mm (1.5 inches). In some embodiments, the first handle portion 316 and second handle portion 338 are at a distance 314 and 340 of between about 76.2 mm (3 inches) and 1,219.2 mm (48 inches) from the slot 102 and 106, respectively. In some embodiments, the first handle portion 316 and second handle portion 338 are at a distance 314 of about 196.85 mm (7.75 inches) from the slot 102 and 106, respectively. In some embodiments, the handle support cutouts 308 and 346 are positioned at a distance 328 of between about 12.7 mm (0.5 inches) and 304.8 mm (12 inches) from the first handle portion 316 and second handle portion 338, respectively. In some embodiments, the handle support cutouts 308 and 346 are positioned at a distance 328 of about 190.5 mm (7.5 inches) from the first handle portion 316 and second handle portion 338, respectively. In some embodiments, the second top flap has a first handle support and the fourth top flap has a second handle support. In some embodiments, the first side wall panel has a first handle portion and the second side wall panel has a second handle portion, wherein the second top flap has a first handle support and the fourth top flap has a second handle support, and wherein the first handle support is capable of engaging with the first handle portion and the second handle support is capable of engaging with the second handle portion.

The container blank 300 has a width 334 of between about 152.4 mm (6 inches) and 3,048 mm (120 inches). In some embodiments, the container blank 300 has a height 336 of between about 152.4 mm (6 inches) and 3,048 mm (120 inches). In some embodiments, the container blank 300 has a width 334 of about 2,057.4 mm (81 inches). In some embodiments, the container blank 300 has a height 336 of about 1,041.4 mm (41 inches).

In another aspect, disclosed herein is a container derived from the container blank disclosed herein, comprising: a) a first end wall panel and a second end panel are adjoined via a glue tab thereby defining an inner container portion and an outer container portion; b) a first pair of minor bottom flaps and a second pair of minor bottom flaps, wherein the first pair of minor bottom flaps and the second pair of minor bottom flaps are folded towards the inner container portion along each minor bottom flap fold line, wherein a first left minor bottom flap overlaps with a second right minor bottom flap, wherein a first right minor bottom flap overlaps with a second left minor bottom flap, wherein each first minor bottom flap is separated by a first minor bottom flap vertical slot, and wherein each second minor bottom flap is separated by a second minor bottom flap vertical slot; c) a first bottom flap and a second bottom flap, wherein the first bottom flap and the second bottom flap each comprise a top half and a bottom half separated by a middle fold line horizontally positioned at about the center of the first bottom flap and the second bottom flap, wherein the first minor bottom flap vertical slot and the second minor bottom flap vertical slot are capable of receiving each bottom half of the first bottom flap and the second bottom flap, wherein the first bottom flap and the second bottom flap are folded toward the inner container portion along each bottom fold line and along each middle fold line, and wherein the first minor bottom flap vertical slot and the second minor bottom flap are folded along each middle fold line in opposite directions thereby forming a flat inner bottom surface of the container; d) a first top flap, wherein the first top flap is connected along the top side of the first end wall panel; e) a second top flap, wherein the second top flap is connected along the top side of the first side wall panel, and wherein the second top flap has a first handle support; f) a third top flap, wherein the third top flap is connected along the top side of the second side wall panel; and g) a fourth top flap, wherein the fourth top flap is connected along the top side of the second end wall panel, wherein the fourth top flap has a second handle support, and wherein the fourth top flap has a second handle support.

Containers may be constructed from container blanks, such as the one illustrated in FIG. 1 and in a plurality steps. The container blanks may have slits, slots and other shapes precut and fold lines demarcated and formed so as to facilitate construction of a container. The container walls and flaps may be formed by folding along the folding lines as desired. Furthermore, glue strip 146 provides a location for placement of an adhesive to assist the container in maintaining its structural integrity and to provide further support.

Figure 3:
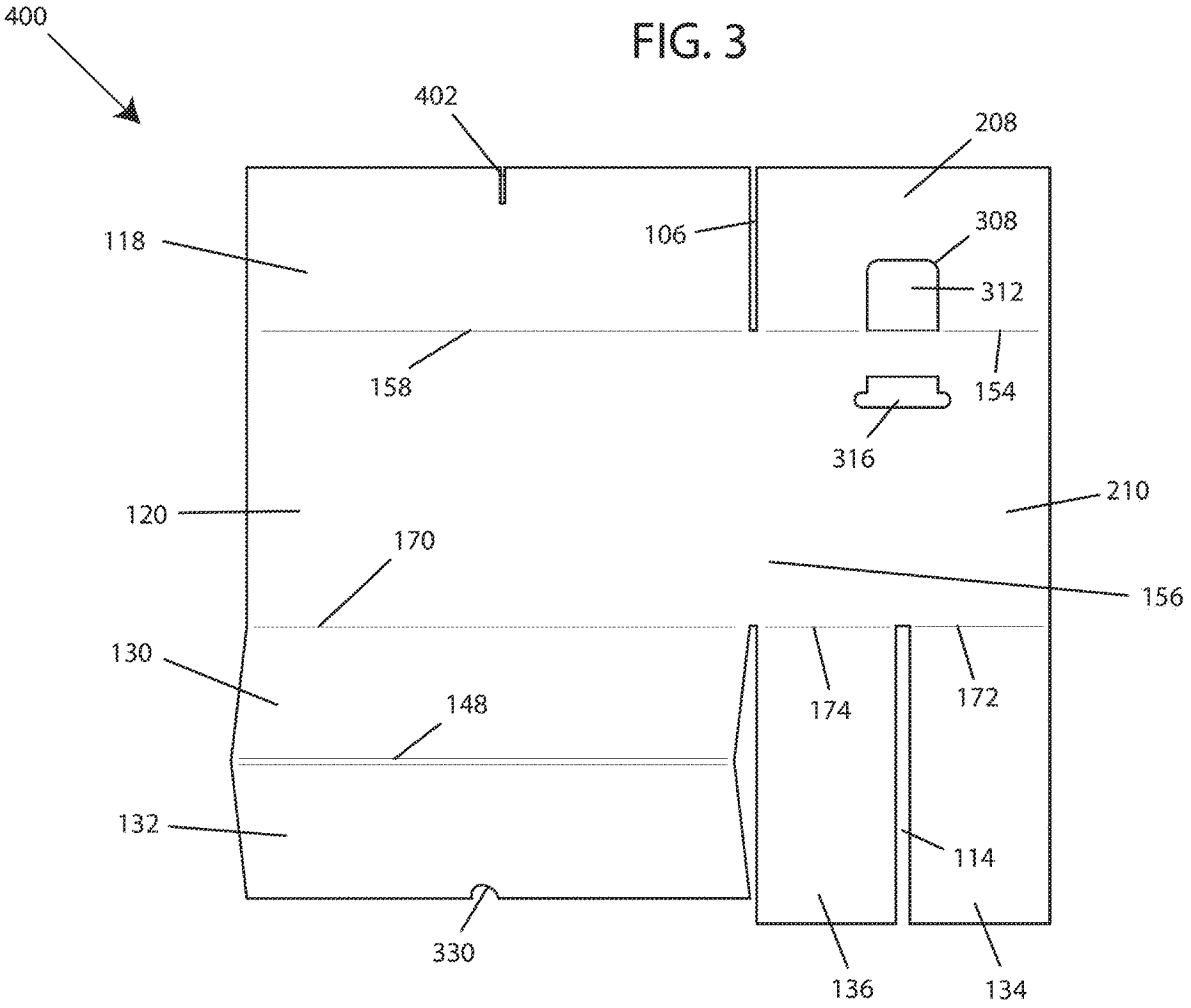
FIG. 3 is an illustration of a side view of a collapsed container 400 derived from the container blank disclosed herein comprising a first side wall panel 210, a second side wall panel 120 and a second bottom flap having a top fold line 170 and a middle fold line 148.

Turning to FIG. 3, the illustration depicts a side view of a collapsed container 400 derived from the container blank disclosed herein comprising a first side wall panel 210, a second side wall panel 120 and a second bottom flap having a top fold line 170 and a middle fold line 148. In this collapsed form, the container 400 may be stacked on pallets. In some embodiments, the first top flap, second top flap, third top flap and fourth top flap of the container derived from the container blank disclosed herein comprise a horizontal fold line. In some embodiments, the first bottom flap, first pair of minor bottom flaps, second bottom flap and second pair of minor bottom flaps of the container derived from the container blank disclosed herein each comprise a horizontal fold line.

Figure 4:
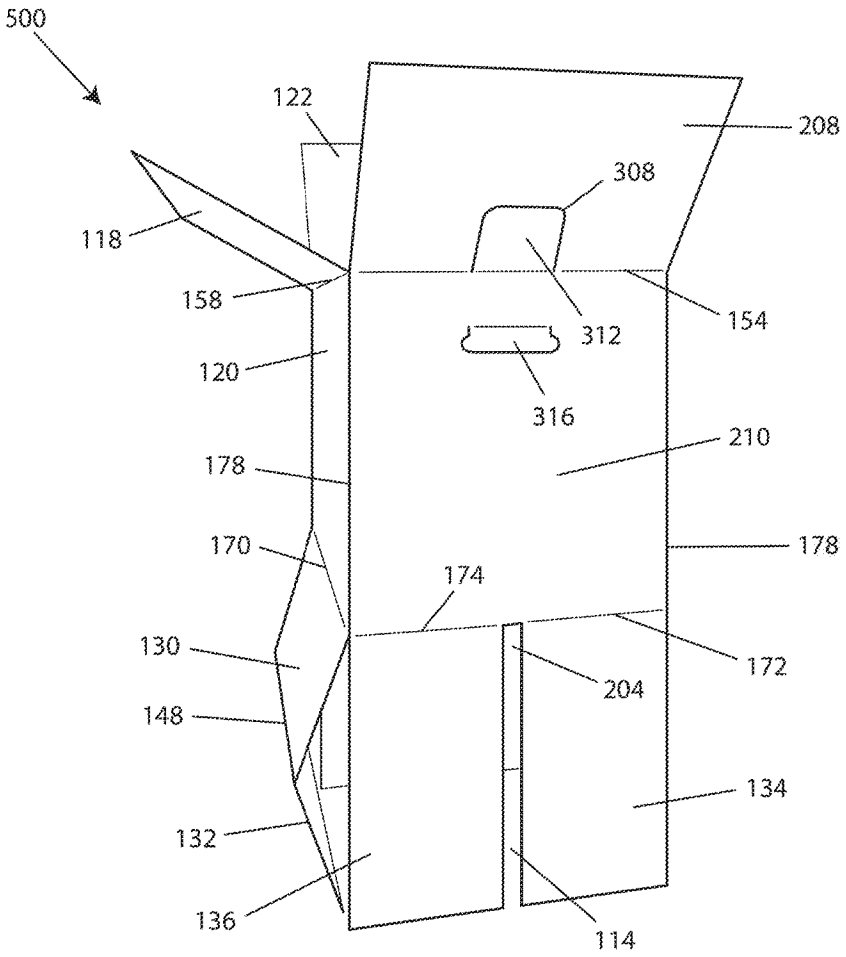
FIG. 4 is an illustration of a side view of a container 500 derived from the container blank disclosed herein comprising a first side wall panel 210, a second side wall panel 120, first pair of minor bottom flaps 134 and 136.
Figure 5:
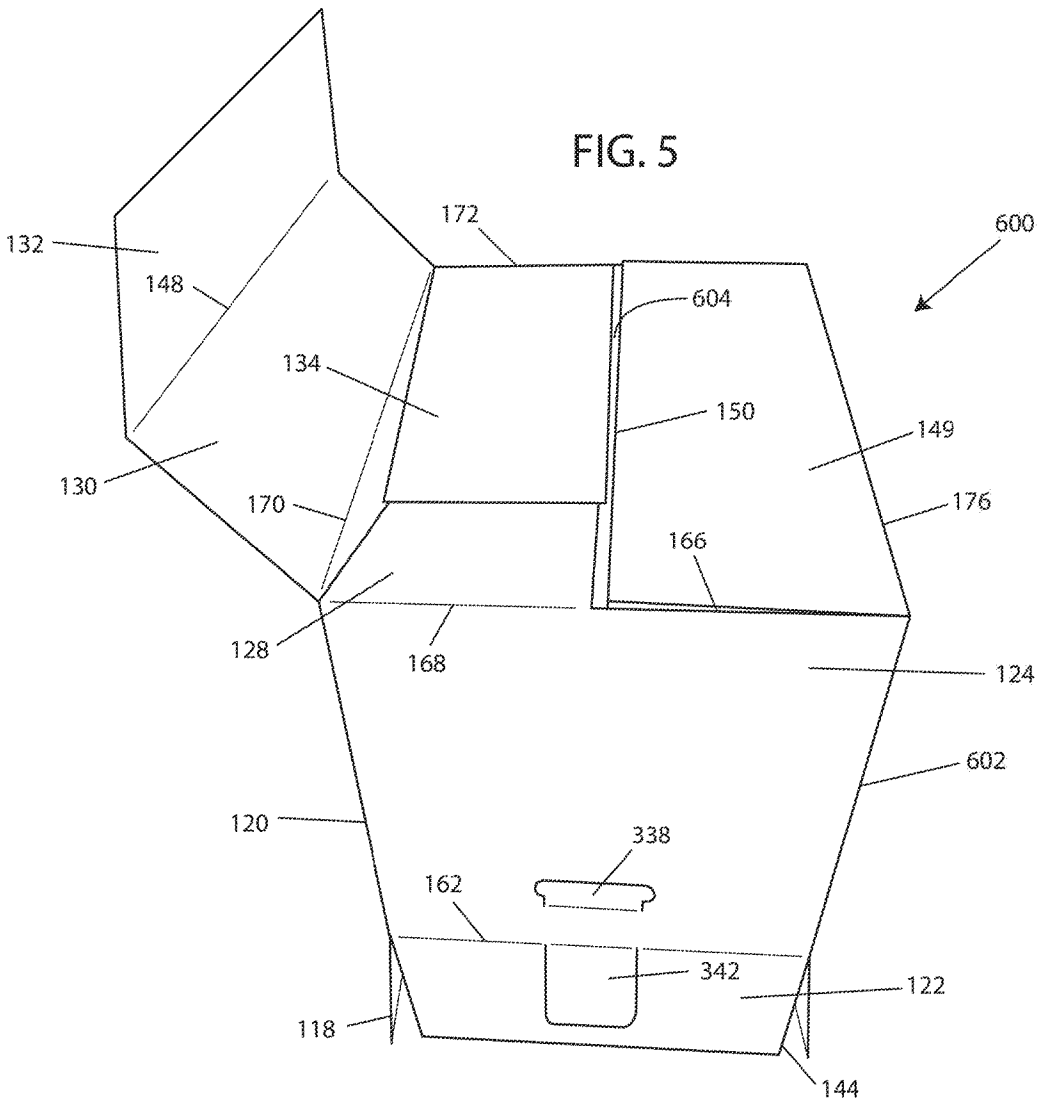
FIG. 5 is an illustration of a partially assembled upside down container 600 the comprising a first bottom flap 138/149, a second bottom flap 103/132 are folded toward the inner container portion along each top fold line 170 and 176 and along each middle fold line 148 and 150, a glue strip 602 a first right minor bottom flap 134 overlaps with a second left minor bottom flap 128.

Turning to FIG. 4, the illustration depicts a side view of a container 500 derived from the container blank disclosed herein comprising a first side wall panel 210, a second side wall panel 120, first pair of minor bottom flaps 134 and 136. The first pair of minor bottom flaps 134 and 136 are folded along fold lines 174 and 172 towards the inner container portion 204. This step is repeated for second pair of minor bottom flaps 128 and 126, which affords a system whereby the first pair of minor bottom flaps 134 and 136 and the second pair of minor bottom flaps 128 and 126 are overlapping for added strength. Moreover, the first minor bottom flap vertical slot 114 and the second minor bottom flap vertical slot 108 are overlapping. In some embodiments, the first minor bottom flap vertical slot 114 and the second minor bottom flap vertical slot 108 each independently have a width between minor bottom flaps of between about 12.7 mm (0.5 inches) and 101.6 mm (4 inches). In some embodiments, the first minor bottom flap vertical slot 114 and the second minor bottom flap vertical slot 108 each independently have a width between minor bottom flaps of about 19.05 mm (0.75 inches). As depicted with FIG. 5, the glue strip seam 602 of is formed via the glue strip 146 of FIG. 1. Moreover, as depicted the overlapping vertical slot 604 comprises the first minor bottom flap vertical slot 114 and the second minor bottom flap vertical slot 108 of FIGS. 1 and 4. The partially assembled upside down view of the container 600 comprises the first bottom flap 138/140 and the second bottom flap 130/132, whereby the first bottom flap 138/140 is folded toward the inner container portion along top fold line 176 and middle fold line 150. In some embodiments, the middle fold line of the first bottom flap of the container derived from the container blank disclosed herein comprises two adjacent fold lines and the middle fold line of the second bottom flap comprises two adjacent fold lines, wherein each middle fold line is horizontally positioned at about the center of the first bottom flap and the second bottom flap.

Figure 6:
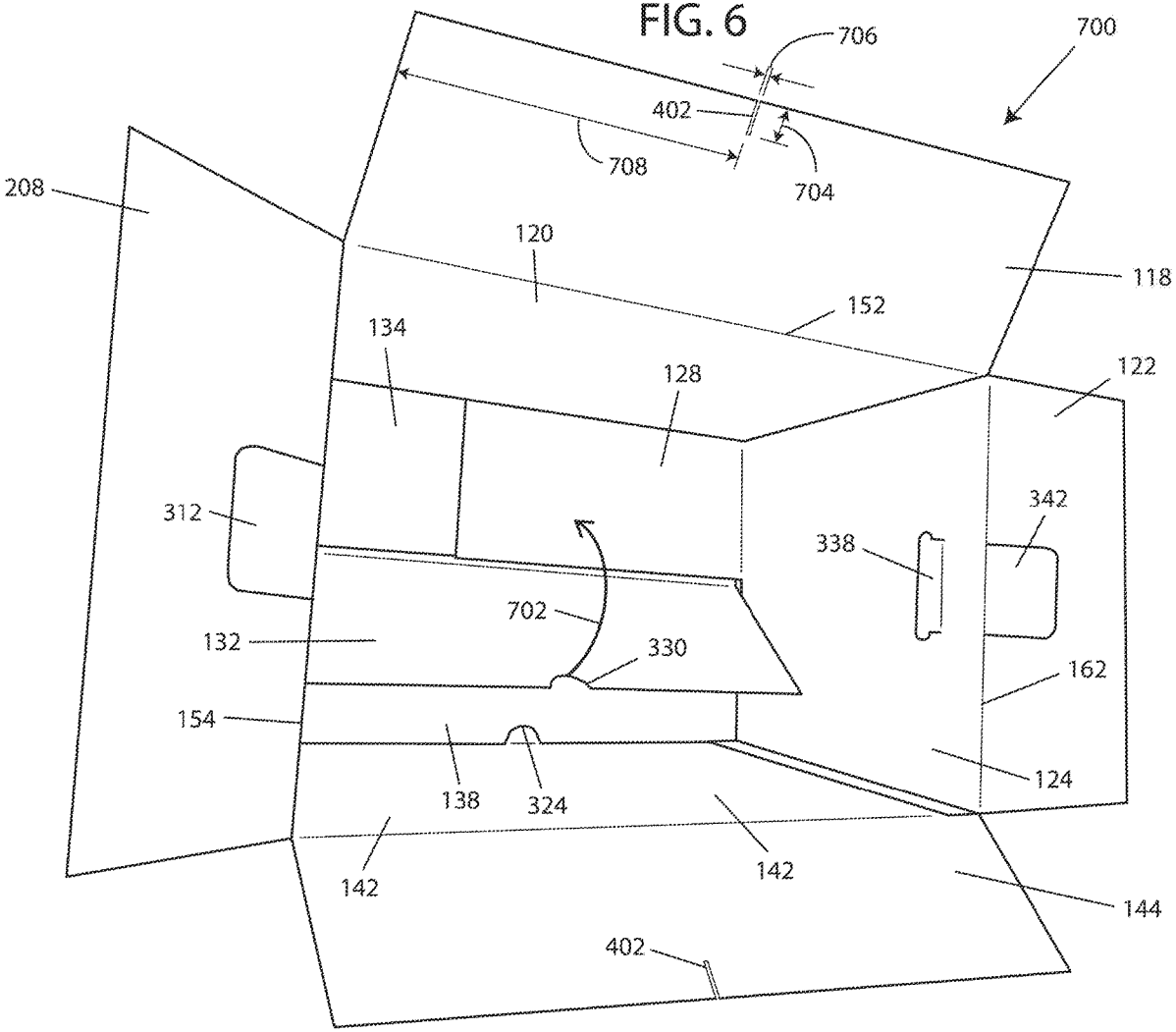
FIG. 6 is an illustration of a partially assembled container 700 the comprising a first bottom flap 138/149, a second bottom flap 103/132 are folded toward the inner container portion along each top fold line 170 and 176 and along each middle fold line 148 and 150, a glue strip 602 and a first right minor bottom flap 134 overlaps with a second left minor bottom flap 128.

This process is repeated with the second bottom flap 130/132 as depicted with FIG. 6. As illustrated, FIG. 6 shows a partially assembled container 700 the comprising a first bottom flap 138/140, a second bottom flap 103/132 are folded toward the inner container portion along each top fold line 170 and 176 and along each middle fold line 148 and 150, a glue strip 602 and a first right minor bottom flap 134 overlaps with a second left minor bottom flap 128. The location of apertures 324 and 330 enable the user to insert a hand and/or fingers to facilitate folding flap 138 and 132 of the first bottom flap 138/140, a second bottom flap 103/132 is opposed directions to provide a flat base within the inner container portion. For example, flap 132 is folded down in direction 702 opposite to flap 138, which is depicted as having been folded down in an opposite direction relative to flap 132. In some embodiments, the apertures 324 and 330 are half-circle shaped along the bottom side 206 of the first bottom flap 138/140 and the second bottom flap 103/132 and positioned at about the center of width 182 and width 190 at a depth of about 12.7 mm (0.5 inches) to about 76.2 mm (3 inches). In some embodiments, the apertures 324 and 330 have a width 320 of between about 25.4 mm (1 inch) and 609.6 mm (24 inches). In some embodiments, the apertures 324 and 330 have a width 320 of about 44.45 mm (1.75 inches). In some embodiments, the apertures 324 and 330 have a depth 326 of between about 25.4 mm (1 inch) and 304.8 mm (12 inches). In some embodiments, the apertures 324 and 330 have a depth 360 of about 25.4 mm (1 inch). In some embodiments, the aperture 324 is positioned at a distance 322 of between about 76.2 mm (3 inches) and 1,219.2 mm (48 inches) from the left edge 200. In some embodiments, the aperture 324 is positioned at a distance 322 of about 288.925 mm (11.375 inches) from the left edge 200. In some embodiments, the aperture 330 is positioned at a distance 332 of between about 76.2 mm (3 inches) and 1,219.2 mm (48 inches) from the slot 112. In some embodiments, the aperture 330 is positioned at a distance 332 of about 288.925 mm (11.375 inches) from the slot 112.

Moreover, the first top flap 144 and the third top flap 118 each comprise a slit 402 capable of interlocking with each other. In some embodiments, the slit 402 is located in the center distance 708 of the first top flap 144 and the third top flap 118 at a width 706 of about 6.35 mm (0.25 inches) and a depth 704 from top edge 202 of about 50.8 mm (2 inches).

Figure 7B:
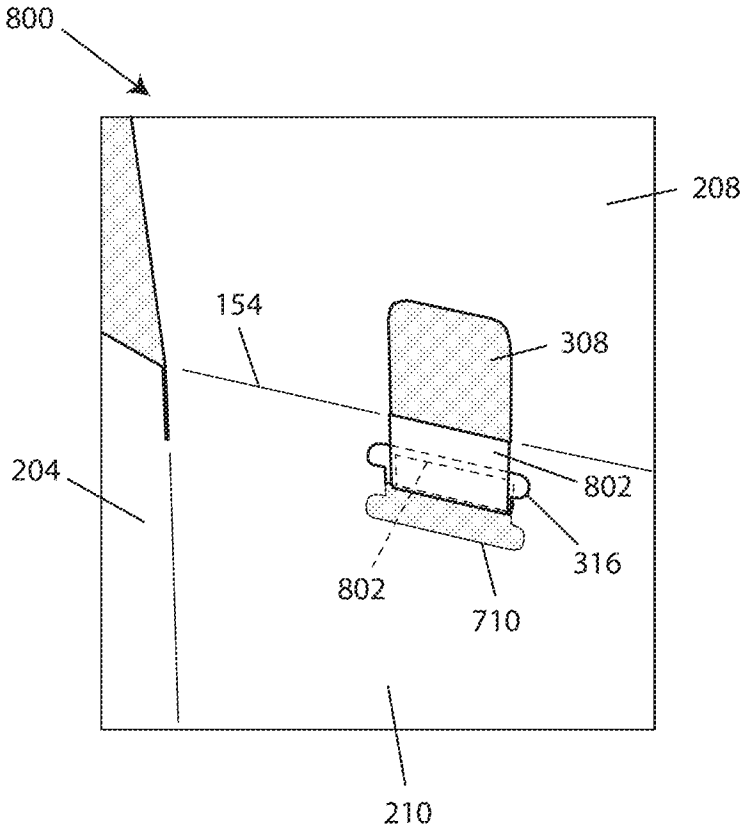
FIG. 7B is an illustration of a view of a container 800 comprising a first handle portion 316, a folded first handle support 802 positioned to support the first handle opening for transporting.
Figure 7A:
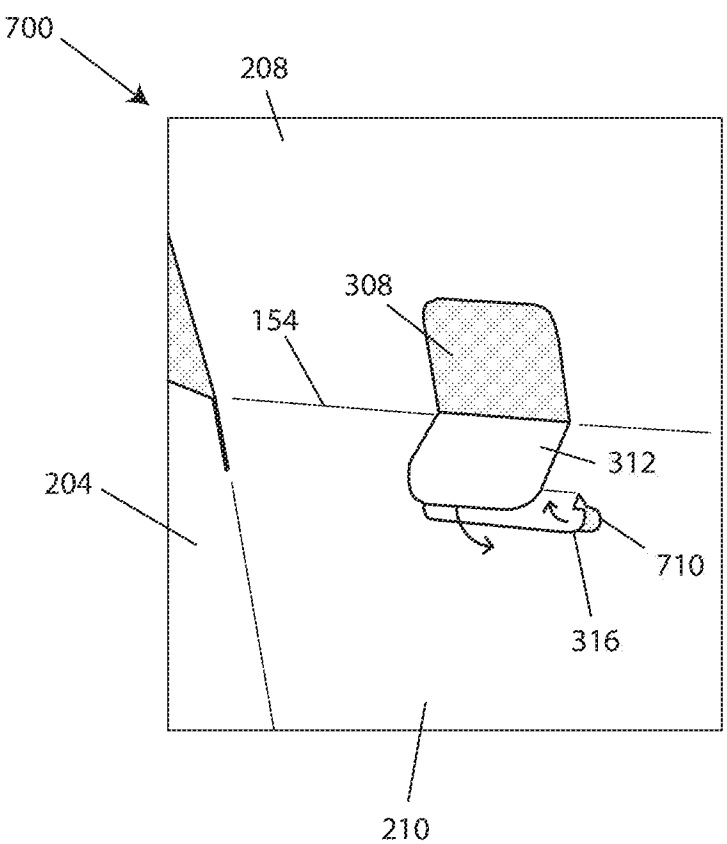
FIG. 7A is an illustration of a view of a container 700 comprising a first handle portion 316, a first handle support 312, a first handle opening 710.

FIG. 7A is an illustration of a view of an inner container portion 204 of a container 700 comprising a first handle portion 316, a first handle support 312, a first handle opening 710. As shown, the first handle portion 316 is folded in the direction depicted and then the first handle support 312 is folded in the direction over the first handle portion 316. FIG. 7B is an illustration of a view of an inner container portion 204 of a container 800 comprising a first handle portion 316, a folded first handle support 802 positioned to support the first handle portion for transporting. As depicted, the folded first handle support 802 is overlaps with the first handle portion 316, which provides added support at the first handle opening 710. Moreover, this method is employed with the second handle portion 338 and the second handle support 342. In some embodiments, the second top flap of the container derived from the container blank disclosed herein has a first handle support and the fourth top flap has a second handle support. In some embodiments, the first side wall panel of the container derived from the container blank disclosed herein has a first handle portion and the second side wall panel has a second handle portion, wherein the second top flap has a first handle support and the fourth top flap has a second handle support, and wherein the first handle support is capable of engaging with the first handle portion and the second handle support is capable of engaging with the second handle portion.

It is noted that the features of the container blank individually and/or in any combination, may improve performance, structural integrity and other benefits of a formed container. The containers as disclosed herein are sized to be suitable for 48 inch by 1,016 mm (40 inch) pallets. In this arrangement, the pallets are loaded 2 containers long and 3 containers wide on a single 1,219.2 mm (48 inch) by 1,016 mm (40 inch) pallets. In some embodiments, the container and container blank are constructed from paperboard, corrugated fiber board or a combination thereof.

Definitions

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items. As used herein, the term "comprising" means including elements or steps that are identified following that term, but any such elements or steps are not exhaustive, and an embodiment can include other elements or steps.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member.

While certain embodiments have been illustrated and described, it should be understood that changes and modifications can be made therein in accordance with ordinary skill in the art without departing from the technology in its broader aspects as defined in the following claims.

The present disclosure is not to be limited in terms of the particular embodiments described in this application. Many modifications and variations can be made without departing from its spirit and scope, as will be apparent to those skilled in the art. Functionally equivalent methods and devices within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods or devices, which can of course vary. It is also to be understood that the terminology used herein is for the purpose of describing particular embodiments only, and is not intended to be limiting.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict any definitions in this disclosure.

What is claimed is:

1. A container comprising:

a first end wall panel having a top, a bottom, a left side and a right side, wherein the first end wall panel has a top fold line, a right side fold line and a bottom side fold line;

a first side wall panel having a top, a bottom, a left side and a right side, wherein the first side wall panel has a top fold line, a right side fold line and is connected along its left side to the right side of the first end wall panel;

a second side wall panel having a top, a bottom, a left side and a right side, wherein the second side wall panel has a top fold line, a right side fold line and a bottom side fold line and is connected along its left side to the right side of the first side wall panel;

a second end wall panel having a top, a bottom, a left side and a right side, wherein the second end wall panel has a top fold line, a right side fold line and a bottom side fold line and is connected along its left side to the right side of the second side wall panel;

a first top flap, wherein the first top flap is connected along a top side of the first end wall panel;

a second top flap, wherein the second top flap is connected along a top side of the first side wall panel, and wherein the second top flap has a first handle support;

a third top flap, wherein the third top flap is connected along a top side of the second side wall panel;

a fourth top flap, wherein the fourth top flap is connected along a top side of the second end wall panel, and wherein the fourth top flap has a second handle support;

a first bottom flap having a middle fold line, wherein the first bottom flap is connected along the bottom side of the first end wall panel;

a first pair of minor bottom flaps are connected to the bottom side of the first side wall panel, wherein the first minor bottom flaps are separated from each other by a first minor bottom flap vertical slot, and wherein each minor bottom flap has a minor bottom flap fold line;

a second bottom flap having a middle fold line, wherein the second bottom flap is connected along the bottom side of the second side wall panel; and a second pair of minor bottom flaps are connected to the bottom side of the second end wall panel, wherein the second minor bottom flap flaps are separated from each other by a second minor bottom flap vertical slot, and wherein each second minor bottom flap has a minor bottom flap fold line;

wherein the first end wall panel and the second end panel are adjoined via a glue tab thereby defining an inner container portion and an outer container portion;

wherein the first pair of minor bottom flaps and the second pair of minor bottom flaps, wherein the first pair of minor bottom flaps and the second pair of minor bottom flaps are folded towards the inner container portion along each minor bottom flap fold line, wherein the first left minor bottom flap overlaps with the second right minor bottom flap, wherein the first right minor bottom flap overlaps with the second left minor bottom flap, wherein the first minor bottom flaps are separated from each other by the first minor bottom flap vertical slot, and wherein the second minor bottom flaps are; separated from each other by the second minor bottom flap vertical slot;

wherein the first bottom flap and the second bottom flap, wherein the first bottom flap and the second bottom flap each comprise a top half and a bottom half separated by a middle fold line horizontally positioned at about the center of the first bottom flap and the second bottom flap, wherein the first minor bottom flap vertical slot and the second minor bottom flap vertical slot are capable of receiving each bottom half of the first bottom flap and the second bottom flap, wherein the first bottom flap and the second bottom flap are folded toward the inner container portion along each bottom fold line and along each middle fold line, and wherein the first minor bottom flap vertical slot and the second minor bottom flap are folded along each middle fold line in opposite directions thereby forming a flat inner bottom surface of the container;

wherein the first top flap, wherein the first top flap is connected along the top side of the first end wall panel;

wherein the second top flap, wherein the second top flap is connected along the top side of the first side wall panel, and wherein the second top flap has the first handle support;

wherein the third top flap, wherein the third top flap is connected along the top side of the second side wall panel; and wherein the fourth top flap, wherein the fourth top flap is connected along the top side of the second end wall panel, and wherein the fourth top flap has the second handle support.

2. The container blank of claim 1, wherein the first pair of minor bottom flaps comprise a first left minor bottom flap and a first right minor bottom flap, wherein the first left minor bottom flap is separated from the first bottom flap by a first bottom flap slot, and wherein the first right minor bottom flap is separated from the second bottom flap by a second bottom flap slot.

3. The container blank of claim 1, wherein the second pair of minor bottom flaps comprise a second left minor bottom flap and a second right minor bottom flap, wherein the second left minor bottom flap is separated from the second bottom flap by a third bottom flap slot.

4. The container blank of claim 1, wherein the first bottom flap and the second bottom flap each comprise a top half and a bottom half separated by a middle fold line horizontally positioned at about the center of the first bottom flap and the second bottom flap, and wherein the first minor bottom flap vertical slot and the second minor bottom flap vertical slot are capable of receiving each bottom half of the first bottom flap and the second bottom flap.

5. The container blank of claim 1, wherein the first bottom flap, first pair of minor bottom flaps, second bottom flap and second pair of minor bottom flaps each comprise a bottom fold line.

6. The container of claim 1, wherein the first side wall panel has a first handle portion and the second end wall panel has a second handle portion.

7. The container of claim 1, wherein the first side wall panel has a first handle portion and the second side wall panel has a second handle portion, wherein the second top flap has the first handle support and the fourth top flap has the second handle support, and wherein the first handle support is capable of engaging with the first handle portion and the second handle support is capable of engaging with the second handle portion.

8. The container of claim 1, wherein the middle fold line of the first bottom flap comprises two adjacent fold lines and the middle fold line of the second bottom flap comprises two adjacent fold lines, wherein each middle fold line is horizontally positioned at about the center of the first bottom flap and the second bottom flap.

9. The container blank of claim 1, wherein the first top flap, second top flap, third top flap and fourth top flap each comprise a top fold line.

10. The container blank of claim 1, wherein the first bottom flap, first pair of minor bottom flaps, second bottom flap and second pair of minor bottom flaps each comprise a top fold line.

* * * * *